US009530388B1

(12) United States Patent
Jansson et al.

(10) Patent No.: US 9,530,388 B1
(45) Date of Patent: Dec. 27, 2016

(54) MECHANISM FOR CHANGING A PITCH OF A GUITAR STRING OF AN ELECTRONIC GUITAR

(71) Applicant: HANDBENDER SWEDEN AB, Torsby (SE)

(72) Inventors: Conny Jansson, Torsby (SE); Stefan Olsson, Torsby (SE)

(73) Assignee: HANDBENDER SWEDEN AB, Torsby (SE)

( * ) Notice: Subject to any disclaimer, the term of this patent is extended or adjusted under 35 U.S.C. 154(b) by 0 days.

(21) Appl. No.: 15/181,785

(22) Filed: Jun. 14, 2016

(30) Foreign Application Priority Data

Jun. 16, 2015 (SE) ..... 1550825-2

(51) Int. Cl.
*G10D 3/14* (2006.01)
*G10D 3/12* (2006.01)

(52) U.S. Cl.
CPC ..... *G10D 3/146* (2013.01); *G10D 3/12* (2013.01)

(58) Field of Classification Search
CPC ..... G10D 3/143; G10D 3/146
See application file for complete search history.

(56) References Cited

U.S. PATENT DOCUMENTS 1,883,410 A * 10/1932 Ryan ..... G10D 3/143 84/312 R
2,201,536 A * 5/1940 Harvey ..... G10D 3/143 84/312 R
2,573,254 A * 10/1951 Fender ..... G10H 3/181 84/307
2,741,146 A * 4/1956 Fender ..... G10D 3/146 84/313
2,825,256 A * 3/1958 Smallwood ..... G10D 3/146 84/313
2,825,257 A * 3/1958 Witt ..... G10D 3/146 84/312 R
2,949,806 A * 8/1960 Turman ..... G10D 3/146 84/297 R
3,174,381 A * 3/1965 Matthew ..... G10D 3/146 84/313
3,250,167 A * 5/1966 Porter ..... G10D 3/143 84/313
3,479,917 A * 11/1969 Zitnik ..... G10D 3/143 84/312 R
3,512,443 A * 5/1970 Parson ..... G10D 3/143 84/313
3,686,993 A * 8/1972 Fender ..... G10D 3/143 257/720

(Continued)

*Primary Examiner* — Robert W Horn
(74) *Attorney, Agent, or Firm* — Thomas & Karceski, PC

(57) ABSTRACT

A mechanism for changing a pitch of a string of an electric guitar having a string supporting bridge mounted on the guitar body, and said bridge having a transverse flange. To be inexpensive and easy to mount on the guitar without requiring neither removal of components from the guitar nor making of new holes in the guitar body, the mechanism comprises a base, an actuating lever device pivotally attached to said base and including string engagement means for connecting a first one of the guitar strings thereto and for varying tension on said first one of the strings by pivoting said actuating lever device relative to said base, and clamping means carried by said base and operable to removably clamp said base to said flange.

20 Claims, 11 Drawing Sheets

(56) References Cited

U.S. PATENT DOCUMENTS

| | | | | | |
|---|---|---|---|---|---|
| 3,990,341 | A * | 11/1976 | Pace, Sr. | G10D 3/143 | 84/297 R |
| 4,354,417 | A * | 10/1982 | Glaser, II | G10D 3/143 | 84/312 R |
| 4,535,670 | A * | 8/1985 | Borisoff | G10D 3/143 | 84/297 R |
| 4,610,190 | A * | 9/1986 | Maloney | G10D 3/143 | 84/312 R |
| 5,140,884 | A * | 8/1992 | Bowden | G10D 3/14 | 84/297 R |
| 5,481,954 | A * | 1/1996 | Parsons | G10D 3/00 | 84/291 |
| 7,329,808 | B2 * | 2/2008 | Davis | G10D 3/143 | 84/298 |
| 7,696,420 | B2 * | 4/2010 | Thompson | G10D 3/146 | 84/173 |
| 9,251,768 | B2 * | 2/2016 | Lionello | G10D 3/143 | |
| 9,299,323 | B1 * | 3/2016 | Jackson | G10D 1/08 | |
| 9,324,308 | B1 * | 4/2016 | Clarke | G10D 3/143 | |
| 2008/0141843 | A1 | 6/2008 | Thompson | | |
| 2016/0232881 | A1 * | 8/2016 | Alday | G10D 3/02 | |

* cited by examiner

MECHANISM FOR CHANGING A PITCH OF A GUITAR STRING OF AN ELECTRONIC GUITAR

CROSS-REFERENCE TO RELATED APPLICATION(S)

This United States patent application claims priority to Swedish Patent Application No. SE 1550825-2, having a filing date of Jun. 16, 2015, the entire content of which is incorporated herein by reference.

TECHNICAL FIELD

The present invention relates to a mechanism for changing a pitch of a guitar string of an electric guitar having a plurality of guitar strings and a guitar body with a string supporting bridge mounted on said guitar body, said strings having a main direction, and said bridge having a protruding flange that has two opposed side surfaces and extends perpendicularly to said main direction and said guitar body.

BACKGROUND ART

A variety of mechanical vibrato systems for guitar have been developed since the 1930s. They are used to add vibrato to the sound by changing the tension of the strings, typically at the bridge or tailpiece of an electric guitar using a controlling lever (often referred to as a whammy bar, vibrato arm/bar, or tremolo arm/bar). The lever enables the player to quickly vary the tension and sometimes the length of the strings temporarily, changing the pitch to create a vibrato or pitch bend effect.

US 2008/0141843 A1 (Thompson) discloses a string bender apparatus that includes a mounting plate with an anchor for anchoring guitar strings to a guitar body, a first section with fastener-receiving holes arranged to receive fasteners extended into pre-existing mounting holes in the body, and an extension that extends from the first section. A lever is pivoted to the extension for movement in a plane that extends generally parallel the front surface of the guitar body. The lever includes a first end defining a handle that is positioned generally adjacent one side of the strings and includes an opposite end attached to one of the strings for temporarily changing a tension of the one string and thus changing a pitch of the one string when the handle is moved in the plane. If desired, the string bender apparatus may include a vibrato. Then, the string bender apparatus is pivotal around its front end and has a second lever for pivoting the rear end of the string bender apparatus upward from the front of the guitar body. The string bender can be retrofit onto existing guitars. The string bender can be made removable and replaced with, or combined with a vibrato. To mount the string bender onto an existing guitar, the anchor or bridge present on the guitar first has to be removed. If possible, the existing holes are used for the mounting of the string bender or else new holes have to be made in the guitar body for screws, bolts or the like, and there is damage to the guitar body.

Another string bender is disclosed in U.S. Pat. No. 5,140,884 (Bowden). Here, the guitar includes a protruding structure such as a bridge or tail piece. The string bender apparatus includes a frame having an actuating lever pivotally attached thereto. The actuating lever is attached to one of the guitar strings for varying the tension on the string by pivoting the actuating lever relative to the frame. An adapter is provided for removably attaching the frame of the string bender apparatus to the protruding structure of the guitar. In the illustrated embodiment, this prior art string bender is mounted on a guitar having a bridge with a top surface in the shape of a roof ridge and spaced therefrom a separate stop bar of generally half-circular cross-section. Each string is laid over the top surface of the bridge and has an enlarged end, which is locked in a passage defined in the tail piece. The string bender is locked to the tail piece by two hollow set screws entering such a passage. The axial bores through the set screws are aligned with the passage through which the guitar string passes through the tail piece to be attached to a grooved rounded end on a rear portion of the pivotal actuating lever.

In another embodiment of the string bender apparatus, the entire apparatus is held in place relative to the guitar by tension in the six guitar strings. Thus, to mount the string bender apparatus onto the guitar, all of the six strings have to be removed and then threaded through the apparatus and the existing openings in the pull-through type bridge and saddle assembly.

The front end of the actuating lever has an inactive end position lifted from the front surface of the guitar body and can be depressed toward the front surface to provide the desired change in pitch. However, to accommodate placement of the guitar in a conventional guitar case, the string bender has to be foldable and thus the frame has to include a fix front part and a rotatable rear part. Such a string bender consists of an unnecessarily large number of parts which makes it expensive and troublesome to mount to a guitar.

SUMMARY OF THE INVENTION

The object of the present invention is to provide a mechanism, which is inexpensive and easy to mount to a bridge of a guitar and does not require neither removal of components from the guitar nor making of new holes in the guitar body.

This object is achieved in that the mechanism specified in the first paragraph above comprises:

- a base, which has at least one surface portion adapted to bear against one of said side surfaces of the protruding flange;
- an actuating lever device pivotally attached to said base, said actuating lever device including string engagement means for connecting a first one of said guitar strings thereto and for varying tension on said first one of the strings by pivoting said actuating lever device relative to said base; and
- clamping means carried by said base and operable to removably clamp said base to both sides of said flange, so as to attach the mechanism to the bridge without any part of said mechanism extending into said guitar body.

With standard tuning and in Scientific pitch the strings are designated $E_2$, $A_2$, $D_3$, $G_3$, $B_3$, and $E_4$, and in Helmholtz pitch E, A, d, g, b, and e'. The guitar string connected to the actuating lever device usually is the B-string, and operation of the actuating lever device then enables a player to mechanically bend the B-string up a whole tone (two frets) to C-sharp.

To facilitate the mounting of the mechanism to the bridge of a guitar, in a first preferred embodiment the clamping means includes:

- at least one hook member integral with the base and adapted to be put down over said protruding flange, said at least one surface portion being positioned on the hook member; and a screw member extending through a matching threaded bore provided in the base, said screw member having one end adapted to bear against one of the opposed side surfaces of the flange, and on tightening of the screw member pull said at least one surface portion on said at least one hook member against the other one of said side surfaces of the protruding flange and thus clamp the mechanism to the bridge of the guitar.

In another preferred embodiment, the mounting of the mechanism to the bridge is facilitated in that the base includes a bottom member having at least one first surface portion adapted to bear against one of said side surfaces of the protruding flange, and a top member having at least one second surface portion adapted to bear against the other one of said side surfaces of the protruding flange, said at least one first surface portion and said at least one second surface portion forming a gap between them, said top member and said bottom member being displaceable relative each other to adjust the width of the gap, said top member and said bottom member having cooperating slanting guide surfaces to provide a reduction of the gap width on moving the top member toward the bottom member, the top member having a slot, and a rotary screw extending through the slot into a threaded bore provided in the bottom member, said screw upon tightening moving the top member toward the bottom member, whereby the cooperating slanting surfaces engage to minimize the gap and thus clamp the mechanism to the bridge of the guitar.

As a bridge of the type having a protruding flange, which has two opposed side surfaces and extends perpendicularly to the main direction of the guitar strings and the guitar body, also has a set of screws, where each screw on rotation displaces a saddle member for an associated one of the strings to adjust the height of the string over the fretboard, the bottom member suitably has at least one recess for receiving heads of screws located in said flange.

The bottom member suitably has four first surface portions that are spaced from one another and are adapted to bear against one of said side surfaces of the protruding flange whereby the mechanism can be securely fastened to the bridge without interfering with the heads of the saddle member adjusting screws.

The top member suitably has two hook members that are spaced from one another, and each hook member has a second surface portion adapted to bear against said other one of said side surfaces of the protruding flange. Each hook may be arranged between two strings or outside the upper and lower string respectively, thereby providing a stable mounting of the mechanism.

Preferably, said actuating lever device includes a first actuating lever, and the base includes a projecting shaft, on which said first actuating lever is journaled for pivotal movement thereon, and a projecting pin, which is parallel to the projecting shaft, said first actuating lever having a recess, said projecting pin extending into said recess to form an end stop at a home position of the first actuating lever. Thereby the end stop at the home position is hidden and the hand of a musician playing the guitar will not risk interfering with the end stop.

It is also preferred that the base includes a first tuning screw for setting a desired maximum pitch of said first one of said guitar strings upon varying tension on said first one of the strings by pivoting said first actuating lever relative to said base. The first tuning screw thereby forms an end stop for the pivotal movement of the first actuating lever on tensioning the string.

Further, the first actuating lever suitably includes a first end and an opposite end, the first end defining a handle adapted to be positioned adjacent a lower side of the guitar strings, and the opposite end including said string engagement means. Hereby, the handle is readily accessible and maneuverable for the little finger of a guitarist.

If desired, the mechanism may further comprise a second actuating lever pivotally attached to said base. Such a second actuating lever includes string engagement means for connecting a second one of said guitar strings thereto and for varying tension on said second one of the strings by pivoting said second actuating lever relative to said base, and both of the actuating levers are pivotal on a common axis. Thereby, the desired pitch can be obtained for more than one string.

To achieve a compact design, it is suitable that also said second actuating lever is journalled on the projecting shaft for pivotal movement thereon.

Then, it is preferred that the base includes a projecting pin, which is parallel to the projecting shaft, said second actuating lever has a through opening and said first actuating lever a recess, and said projecting pin extends through said through opening and into said recess to form end stops at a home position of each of the actuating levers. Thereby the end stops at the home positions are hidden and the hand of a musician playing the guitar will not risk interfering with the end stops.

Further, it is also preferred that the base includes a second tuning screw for setting a desired maximum pitch of said second one of the guitar strings upon varying tension on said second one of the strings by pivoting said second actuating lever relative to said base. The second tuning screw thereby forms an end stop for the pivotal movement of the second actuating lever on tensioning the string.

In another embodiment, it may be desirable to use the mechanism to lower the pitch of a guitar string, such as the $E_2$-string, a whole tone step from $E_2$ to $D_2$. Then, said actuating lever device includes a third actuating lever and a fourth lever that includes said string engagement means and is operatively connected to the third actuating lever, and said base includes a second projecting shaft, on which said third actuating lever is journaled for pivotal movement thereon, and a third projecting shaft, on which the fourth lever is journaled for pivotal movement thereon, said third actuating lever includes a first end and an opposite end, the first end defining a handle adapted to be positioned adjacent a top side of the guitar strings, and the opposite end includes a first guide surface, said fourth lever having a first arm including said string engagement means, and a second arm having a second guide surface cooperating with said first guide surface. In this embodiment, there is no first actuating lever and no second actuating lever. The third actuating lever is the sole actuating lever and is so termed in order not to be mixed up with the first actuating lever.

The tension force in the string attached to the string engagement means on the first arm acts to rotate the fourth lever, but the first and second guide surface together suitably form an eccentric lock when the handle of the third actuating lever is in a home position adjacent said top side of the guitar strings.

Preferably, the base includes a third tuning screw for setting a desired minimum pitch of said first one of said guitar strings upon varying tension on said first one of the strings by pivoting said third actuating lever and thereby also the fourth lever relative to said base, said fourth lever having a third arm, the pivotal movement of which is stopped by a free end of the third tuning screw. By pivoting the third actuating lever from its home position, the eccentric lock is opened, the tension in the string makes the fourth lever rotate to make its third arm bear on the free end of the tuning screw so as to permit the pitch of the string to be lowered a whole tone step.

In still another embodiment, it may be desirable to provide a third actuating lever device to the mechanism that already includes the actuating lever device and, if desired, also a second actuating lever. In such an embodiment, the mechanism further comprises a third actuating lever device pivotally attached to said base, and said third actuating lever device includes string engagement means for connecting a third one of said guitar strings thereto and for varying tension on said third one of the strings by pivoting said third actuating lever device relative to said base.

It is preferred that said third actuating lever device includes a third actuating lever and a fourth lever that includes said string engagement means and is operatively connected to the third actuating lever. It is also preferred that the base includes a second projecting shaft, on which said third actuating lever is journaled for pivotal movement thereon, and a third projecting shaft, on which the fourth lever is journaled for pivotal movement thereon. The third actuating lever suitably includes a first end and an opposite end, the first end defining a handle adapted to be positioned adjacent a top side of the guitar strings, and the opposite end includes a first guide surface. The fourth lever suitably has a first arm including said string engagement means, and a second arm having a second guide surface cooperating with said first guide surface. Together, the first and second guide surface form an eccentric lock when the handle of the third actuating lever is in a home position adjacent a top side of the guitar strings. It is also preferred that the base includes a third tuning screw for setting a desired minimum pitch of said third one of said guitar strings upon varying tension on said third one of the strings by pivoting said third actuating lever relative to said base, Suitably, the fourth lever has a third arm, the pivotal movement of which is stopped by a free end of the third tuning screw.

To make the string engagement means simple, reliable and inexpensive, it suitably includes a through bore of sufficient width to permit a guitar string to pass through the bore but yet prevent an end piece on the guitar string to pass.

Then, the base preferably includes a recess or a bore to permit a free passage of a guitar string from the string supporting bridge to the actuating lever. Thereby, the guitar string connected to the mechanism can extend freely and straight from the string end piece to the saddle member so that there is no risk of a set tension in the string suddenly being reduced and the string getting out of tune.

BRIEF DESCRIPTION OF THE DRAWINGS

In the following, the invention will be described in more detail with reference to preferred embodiments and the appended drawings.

FIG. 16 is a close-up perspective view of the openings in the lever and the shaft and pin extending there through.

MODE(S) FOR CARRYING OUT THE INVENTION

Figure 1:
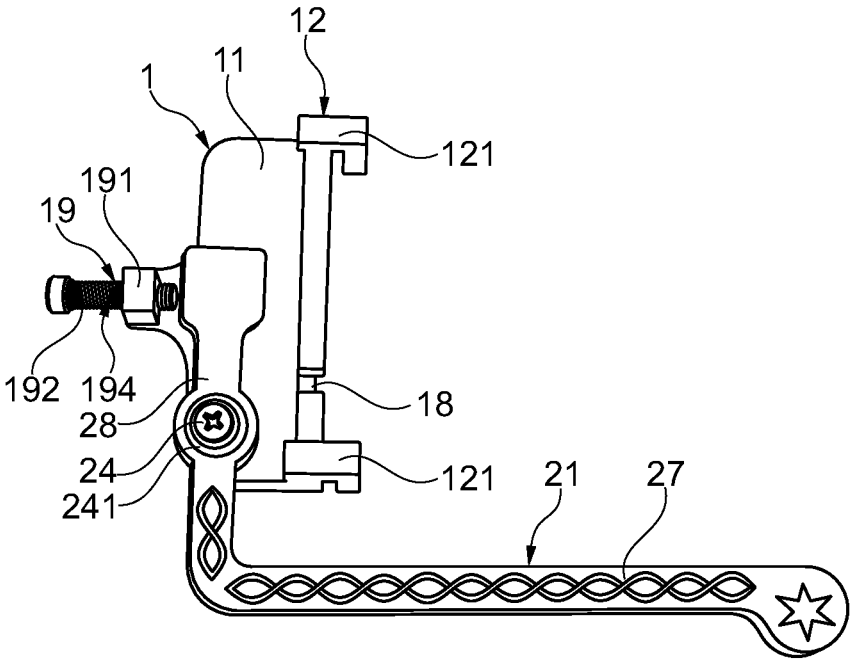
FIG. 1 is a front perspective view of a first preferred embodiment of a mechanism according to the invention.
Figure 2:
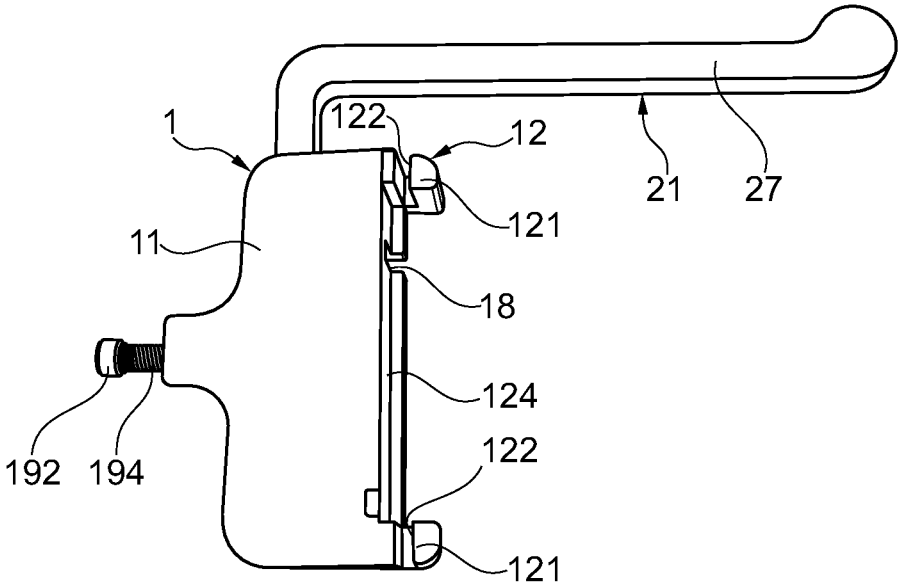
FIG. 2 is a rear perspective view of the mechanism of FIG. 1.
Figure 3:
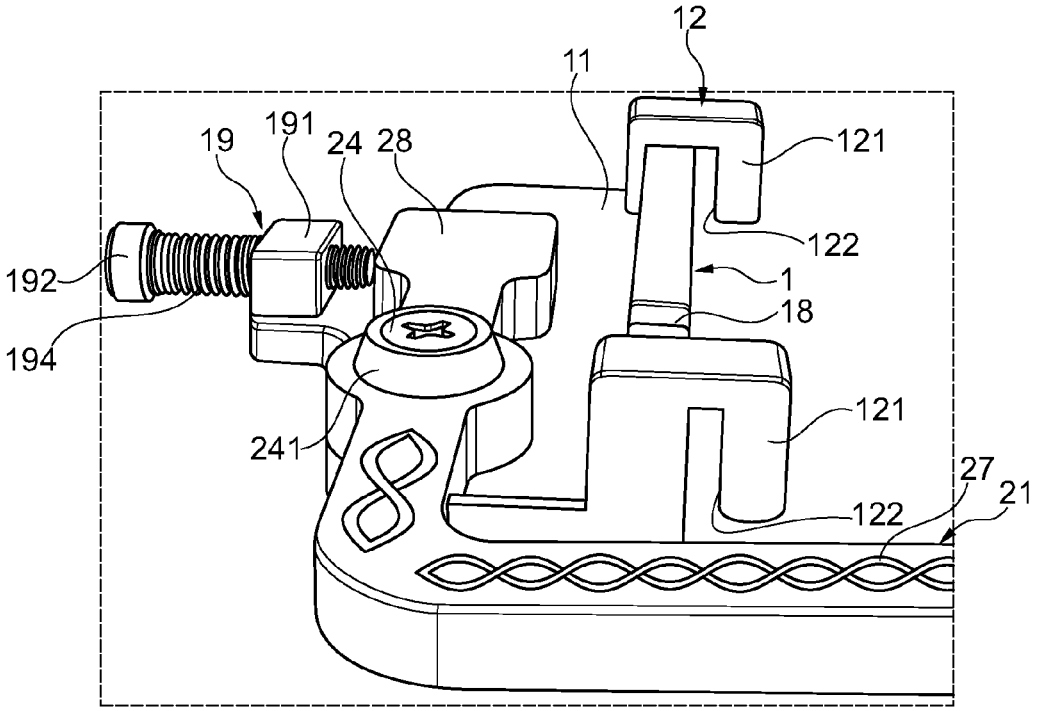
FIG. 3 is a side perspective view of the mechanism of FIG. 1.
Figure 4:
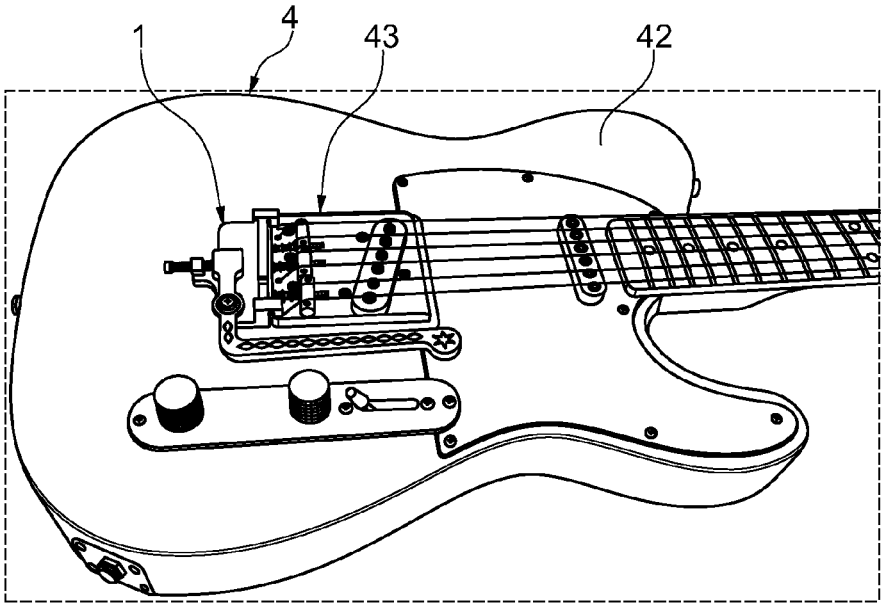
FIG. 4 is a perspective view of a guitar onto which the mechanism of FIG. 1 is mounted.
Figure 5:
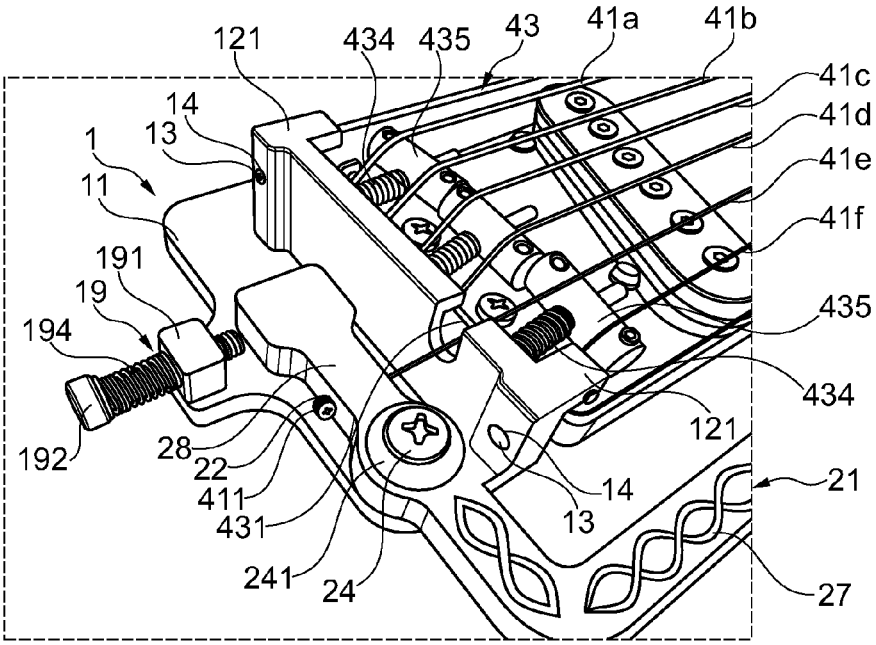
FIG. 5 is a perspective close-up view of the mechanism of FIG. 1 mounted on the guitar.

FIGS. 1-5 show a first preferred embodiment of a mechanism 1 in accordance with the invention for an electric guitar 4, which has a plurality of guitar strings 41*a*-41*f* and a guitar body 42. With standard tuning and in scientific pitch the strings are designated $E_2$, $A_2$, $D_3$, $G_3$, $B_3$, and $E_4$, and in Helmholtz pitch E, A, d, g, b, and e'. The guitar 4 has a string supporting bridge 43 mounted on the guitar body 42, the strings 41 have a main direction, and the bridge 43 has a protruding flange 431 (FIG. 5) that has two opposed side surfaces 432 and 433 (see FIG. 6) and extends perpendicularly to said main direction of the strings and said guitar body 42. FIGS. 1-3 show the proper mechanism 1, and FIGS. 4 and 5 show it mounted onto the bridge 43 of "ashtray" string-through type of the electric guitar 4, which here is a Fender Telecaster.

Figure 6:
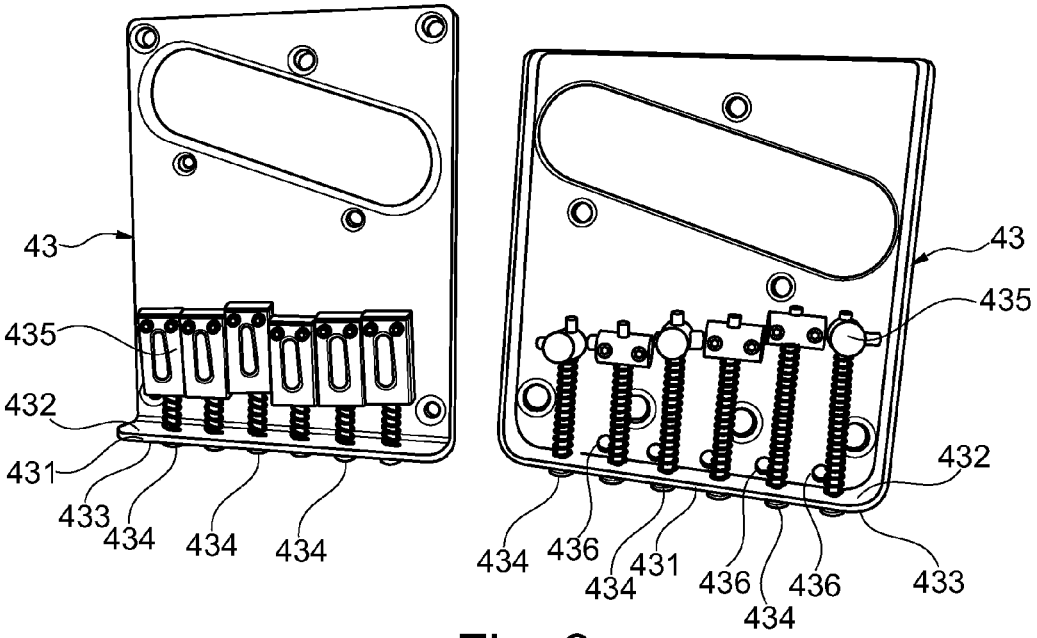
FIG. 6 is a perspective view of two different bridges having a protruding crosswise extending flange onto which the mechanism of FIG. 1 can be mounted.

The protruding flange 431 also has a set of adjusting screws 434, and each screw 434 on rotation displaces a saddle member 435 for adjusting the height of the strings 41 over the fretboard of the guitar 4. From the saddle members 435 the strings 41 extend through bores 436 (see FIG. 6) provided in a bottom of the bridge 43 and are anchored on the rear side of the guitar body 42 (not shown). In the embodiment shown in FIGS. 4 and 5 there are three screws 434 for adjusting three saddle members 435, and each saddle member 435 supports two guitar strings 41. FIG. 6 shows two other types of string-through bridges 43 that both have separate screws 434 and other types of saddle members 435 for all of the six guitar strings 41. The right hand bridge 43 in FIG. 6 also shows the through bores 436 for passing the strings 41 from the rear side of the guitar body 42 through the bottom of the bridge 43 to the saddle members 435. The two types of bridges 43 shown in FIG. 6 are also shown in FIGS. 7-10, but then with another embodiment of the mechanism 1.

The mechanism 1 comprises a base 11 and clamping means 12 carried by said base 11 and operable to removably clamp said base 11 to the two sides 432 and 433 of said flange 431, so as to attach the mechanism 1 to the bridge 43 without any part of said mechanism 1 extending into said guitar body 42. The base 11 has at least one surface portion 122 included in the clamping means 12 and adapted to bear against one 432 of said side surfaces 432 and 433 of the protruding flange 431. The base 11 also has a joint recess 124 for receiving the heads of the screws 434 located in said flange 431, but if desired a separate recess for each one of the screw heads may be provided.

The mechanism 1 further comprises an actuating lever device 21 pivotally attached to said base 11. In the embodiment shown in FIGS. 1-5 the actuating lever device is a first actuating lever 21 that includes string engagement means 22 for connecting a first one 41*e* of said guitar strings 41*a*-41*f* thereto and for varying tension on said first string 41*e* by pivoting said first actuating lever 21 relative to said base 11. Usually, string 41*e* is the $B_3$ string, and operation of the first actuating lever then enables a player to mechanically bend the $B_3$-string up a whole tone (two frets) to $C_4$ (C-sharp). However, if desired, the first actuating lever 21 could be connected to one of the other guitar strings 41*a*-41*d* and 41*f* to vary the tension of that string. As the mechanism 1 does not require neither removal of components from the guitar 4 nor making of new holes in the guitar body 42, it is easy to mount it on the guitar 4 and remove it there from, and the guitar 4 is not damaged in any way but retains its value.

The first actuating lever 21 suitably is generally L-shaped and includes a first end 27 and an opposite end 28. The first end defines a handle 27 adapted to be positioned adjacent a lower side of the guitar strings 41, and the opposite end 28 includes the string engagement means 22. Hereby, the handle 27 is readily accessible and maneuverable for the little finger of a guitarist. The string engagement means 22 may be of various designs well known to a person skilled in the art, but as best shown in FIG. 5, it preferably is formed by the mouth of a through bore 26 (see FIG. 18) of sufficient width to permit a guitar string 41 to pass through the bore 26 but yet prevent an end piece 411 on the guitar string 41 to pass. The end piece 411 usually is a ring type end piece. If desired, a slot (not shown) may be substituted for the through bore 26. Further, the base 11 preferably includes a recess 18 (FIG. 3) or a bore to permit a free passage of a guitar string 41 from the string supporting bridge 43 to the actuating lever 21. Thereby, the guitar string 41 connected to the mechanism 1 can extend freely and straight from the string end piece 411 to the saddle member 435 so that there is no risk of a set tension in the string 41 suddenly being reduced and the string 41 getting out of tune. The shown design contributes to the making of the string engagement means 22 simple, reliable and inexpensive.

Figure 14:
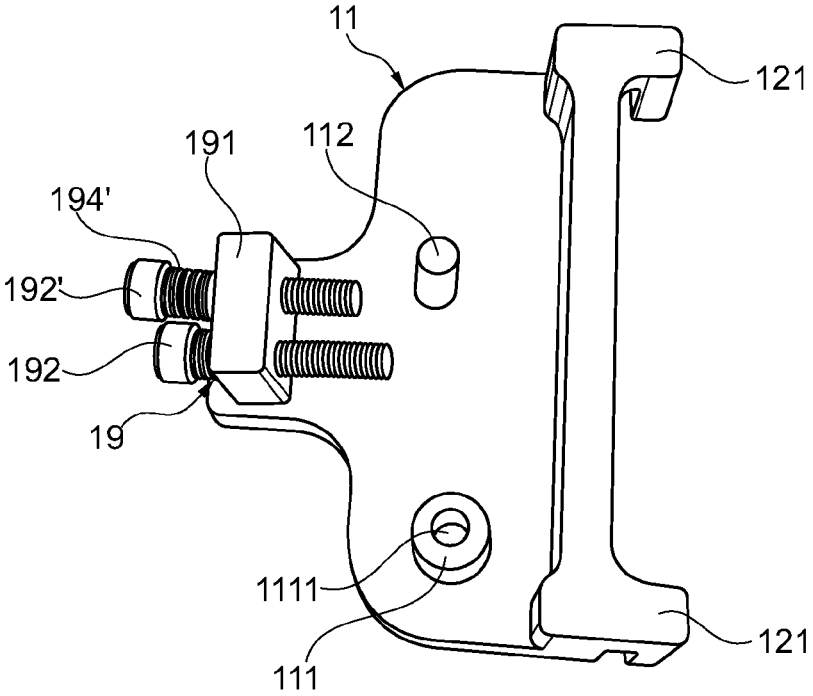
FIG. 14 is a close-up perspective view of the base of FIG. 13 having a projecting shaft for pivotal movement of the actuating levers and a projecting pin for limiting the pivotal movement.
Figure 15:
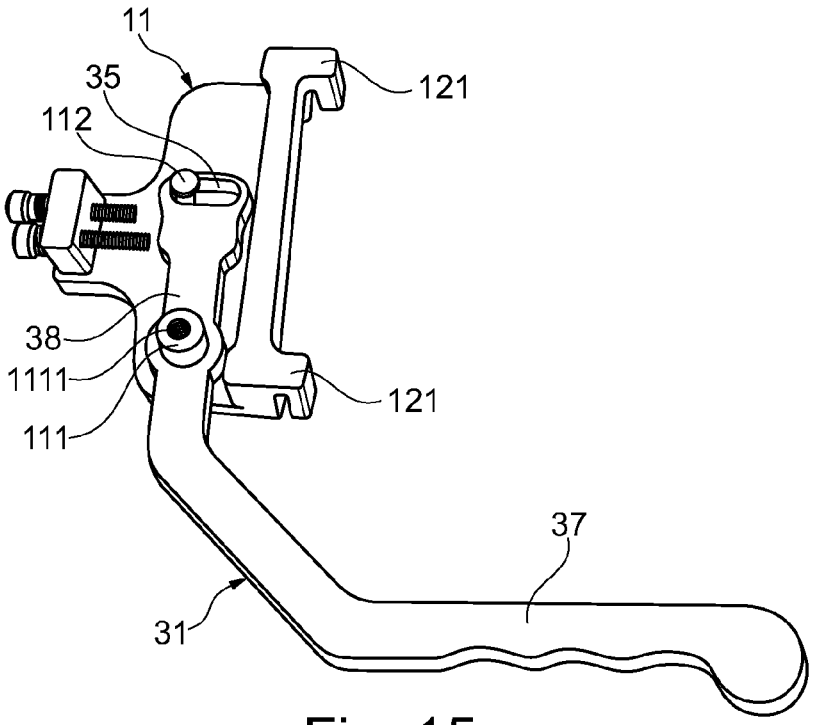
FIG. 15 is a perspective view of the second actuating lever in place on the base, the shaft and the pin extending through openings in the second lever.
Figure 16:
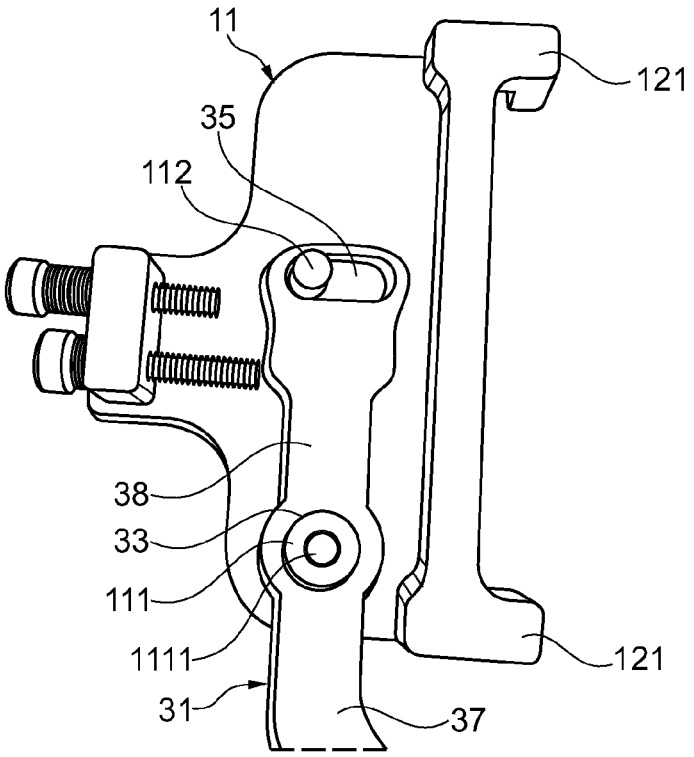
Figure 17:
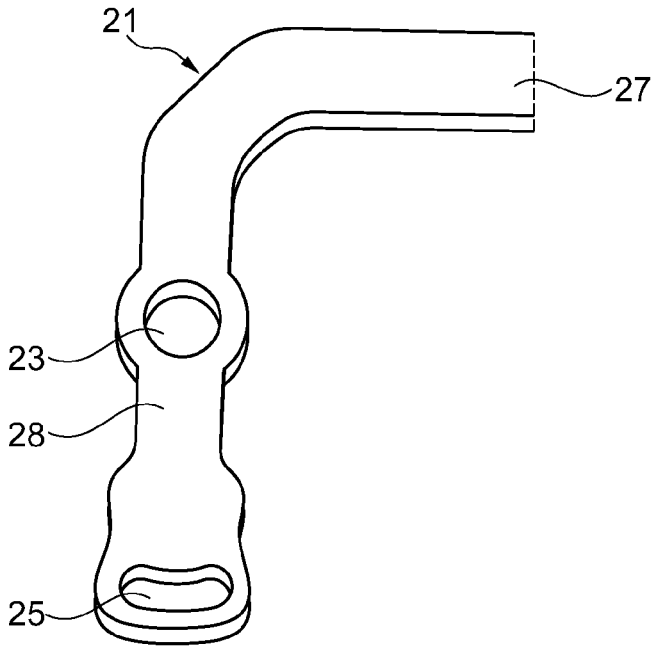
FIG. 17 is a bottom view of the first actuating lever showing an opening for the shaft and a recess for receiving the free end of the pin.

As is best shown in FIGS. 14-16, the base 11 includes a projecting shaft 111, on which said first actuating lever 21 is journaled for pivotal movement thereon, and a projecting pin 112, which is parallel to the projecting shaft 111. FIG. 17 shows that the first actuating lever 21 has a bore 23 for the shaft 111 and a recess 25, into which the projecting pin 112 extends to form an end stop at a home position of the first actuating lever 21. The tension of the guitar string 41 attached to the opposite end 28 of the first actuating lever 21 endeavors to keep the first actuating lever 21 in its home position. Thereby the end stop at the home position is hidden and the hand of a musician playing the guitar will not risk interfering with the end stop. Further, the projecting shaft 111 has a central threaded bore 1111 shown in FIGS. 14-16, and the first actuating lever 21 is prevented from leaving the shaft 111 by the head of a screw 24 shown in FIGS. 1 and 3 fitted in the threaded bore 1111. The head of the screw 24 suitably has a countersunk/flat head or an oval/rounded head to protect the hand of a musician playing the guitar. If desired, a finishing (countersunk) washer 241 or the like may be interposed between the head of the screw 24 and the first actuating lever 21.

To facilitate the mounting of the mechanism 1 to the bridge 43 of a guitar 4, in a first preferred embodiment the clamping means 12 includes at least one hook member 121 integral with the base 11 and adapted to be put down over said protruding flange 431, and the at least one surface portion 122 is positioned on the hook member 121. Further, the clamping means 12 include a screw member 13 extending through a matching threaded bore 14 provided in the base 11. The screw member 13 preferably is a set screw and has one end adapted to bear against one 432 of the opposed side surfaces 432 and 433 of the flange 431, and on tightening of the screw member 13 pull said at least one surface portion 122 on said at least one hook member 121 against the other one 433 of said side surfaces 432 and 433 of the protruding flange 431 and thus clamp the mechanism 1 to the bridge 43 of the guitar 4. As shown in FIGS. 1-5, the mechanism 1 preferably includes two hook members 121, one positioned on the top side and the other at the bottom side of the strings 41 and one set screw 13 for each hook member 121. The screw member 13 preferably acts on the rearward side 433 of the protruding flange 431, thereby pushing the base 11 rearward. However, the skilled person understands that the screw member 13 may instead be arranged to act on the forward side 432 of the flange via threaded bores 13 arranged in the free end of the hook members 121 thereby pushing the base 11 forward such that opposite surface portion 122' of the hook member 121 is clamped against the rearward side surface 433 of the protruding flange 431. The skilled person further understands that the hook members 121 may be arranged to run around the vertical edges of the protruding flange 431 on the top side and the bottom side of the strings 41.

It is also preferred that the base 11 includes a first tuning screw 192 for setting a desired maximum pitch of said first one 41*e* of the guitar strings 41*a*-41*f* upon varying tension on said first one 41*e* of the strings by pivoting said first actuating lever 21 relative to said base 11. The first tuning screw 192 thereby forms an end stop for the pivotal movement of the first actuating lever 21 when using the lever 21 for tensioning the string 41*e* to change the pitch. The first tuning screw 192 is included in a tuning arrangement 19 including a peg 191 projecting from the base 11 and having a bore 193 (FIGS. 9 and 10) with threads matching the screw threads. The tuning screw 192 extends through the bore 193, here in the same direction as the extension if the strings. A helical compression spring 194 surrounds the screw shank between the screw head and the peg 191 to preload the thread connection to avoid inadvertent loosening or tightening of the tuning screw 192.

Figure 7:
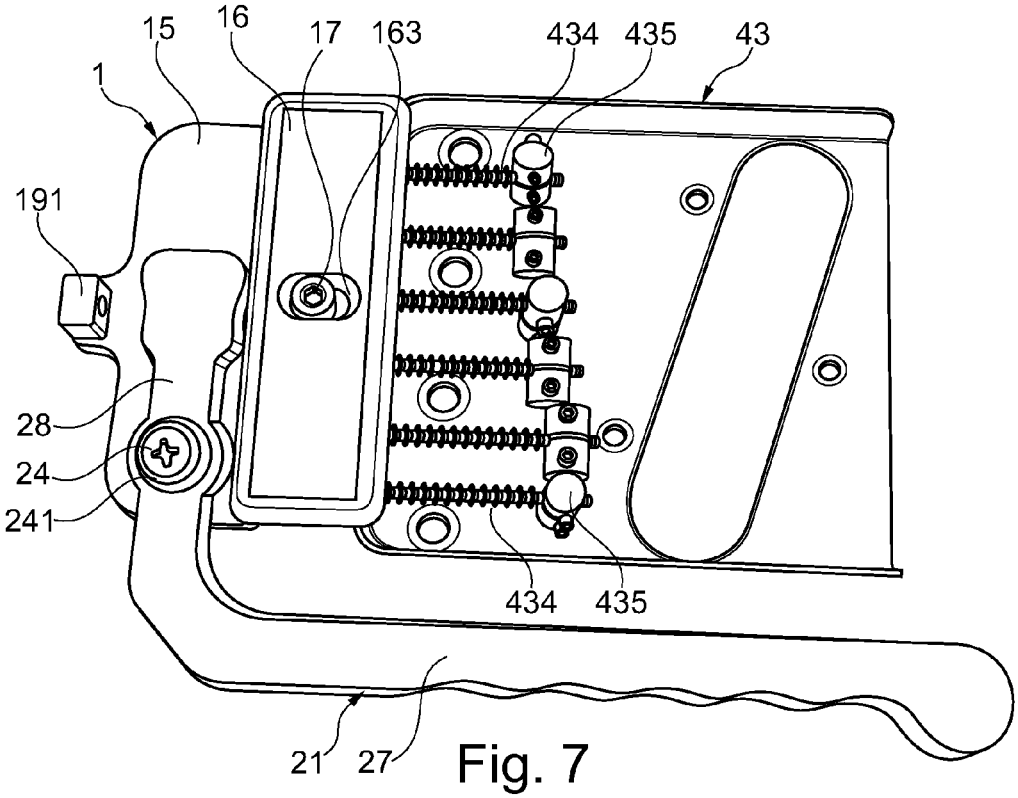
FIG. 7 is a front perspective view of a second preferred embodiment of a mechanism according to the invention, with a base having a bottom member and a top member for clamping the mechanism onto a protruding crosswise extending flange on a bridge.
Figure 8:
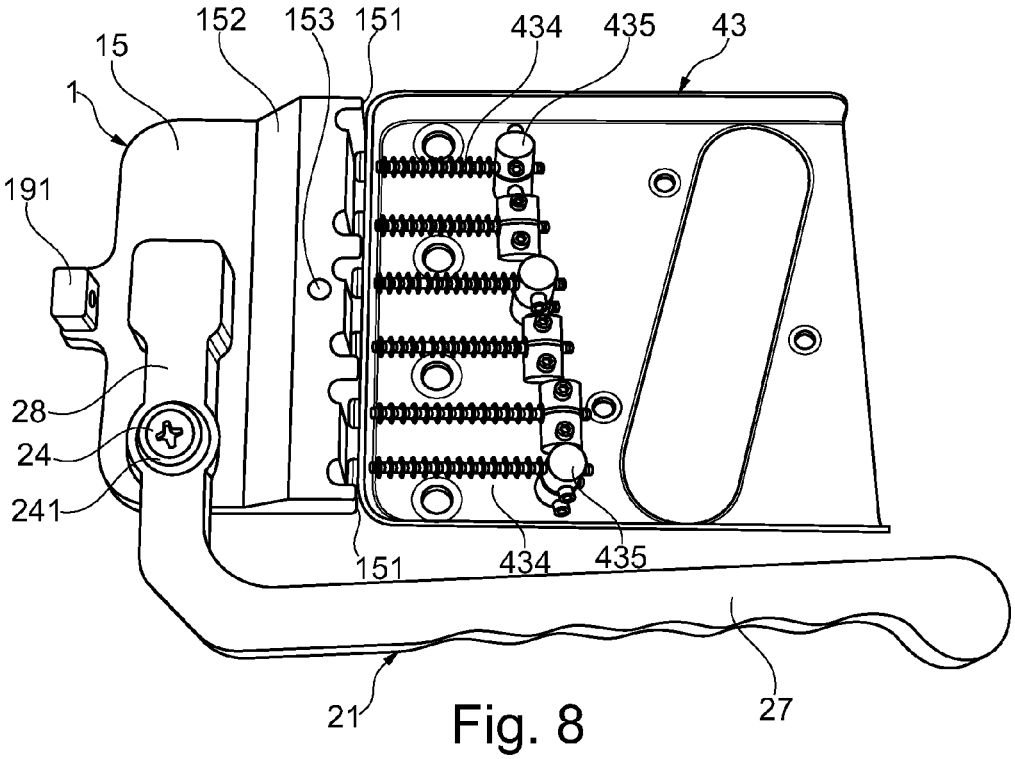
FIG. 8 is a perspective view of the mechanism of FIG. 7 but with the top member removed.
Figure 9:
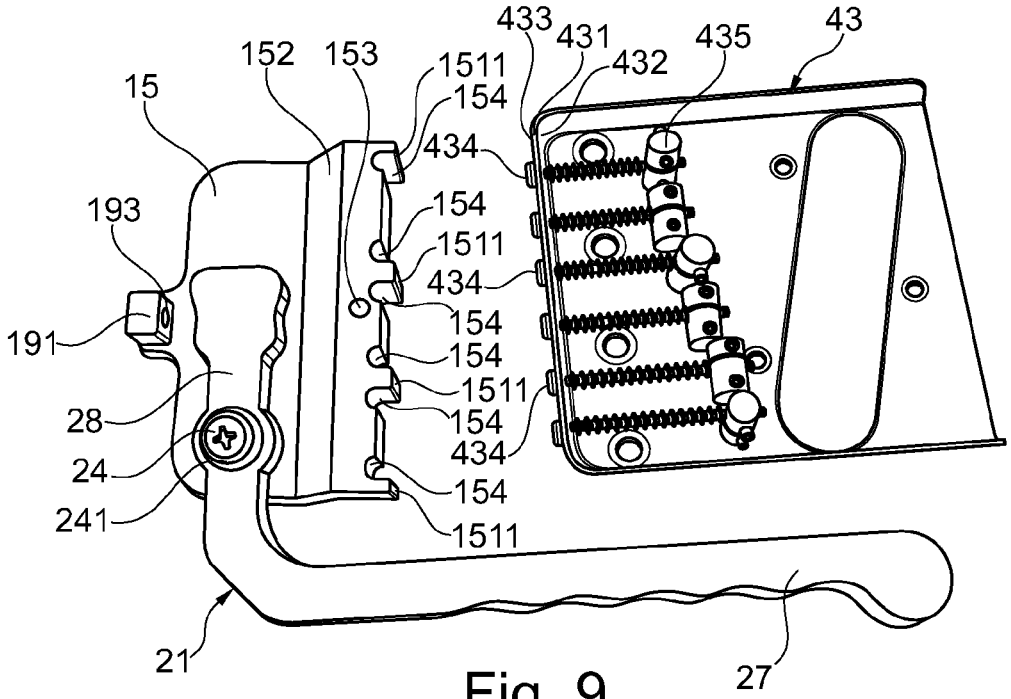
FIG. 9 is a perspective view similar to FIG. 8 but with the mechanism and the bridge spaced apart from each other.
Figure 10:
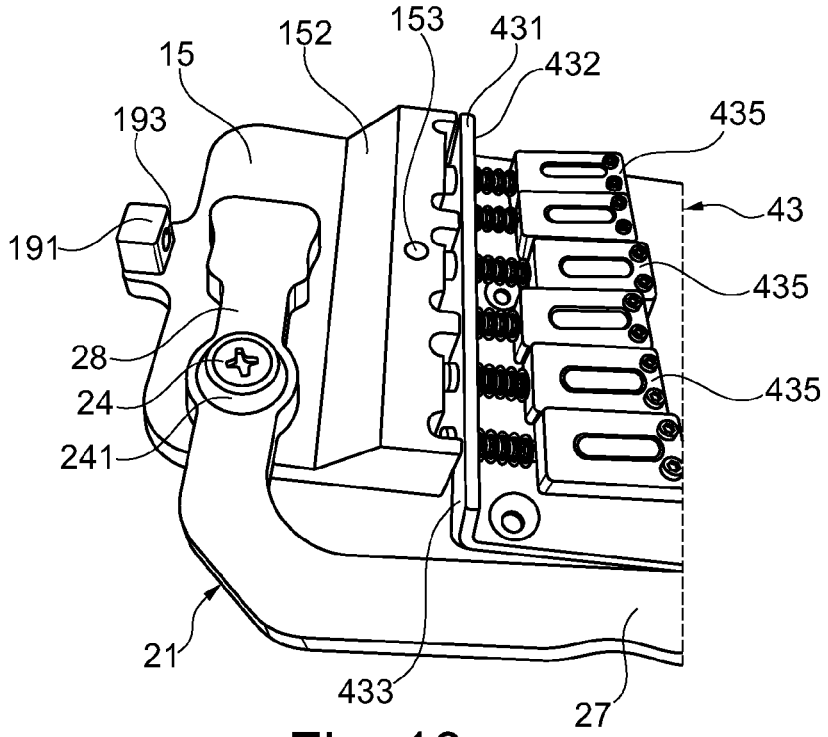
FIG. 10 is a perspective view similar to FIG. 8 but with the mechanism ready to be attached to different bridge.
Figure 11:
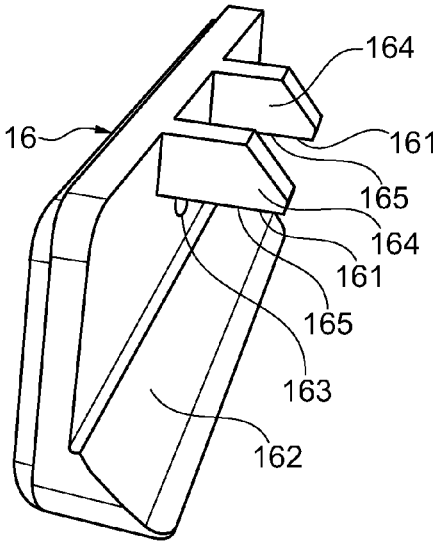
FIG. 11 is a perspective view of the top portion of the base in the mechanism of FIG. 7.

In another preferred embodiment shown in FIGS. 7-11, the mounting of the mechanism 1 to the bridge 43 is facilitated in that the base 11 includes a bottom member 15 having at least one first surface portion 151 adapted to bear against one 433 of said side surfaces 432 and 433 of the protruding flange 43, and a top member 16 shown in FIGS. 7 and 11 having at least one second surface portion 161 adapted to bear against the other one 432 of said side surfaces 432 and 433 of the protruding flange 43. The at least one first surface portion 151 and the at least one second surface portion 161 form a gap between them, and the top member 16 and the bottom member 15 are displaceable relative each other to adjust the width of the gap. Further, as best shown in FIG. 9, the at least one first surface portion 151 suitably has at least one recess 154 for receiving the heads of the saddle member adjusting screws 434. In FIG. 8 there are three recesses 154 having a shallow middle portion and two deeper end portions for the heads of the screws 434, so as to form four first surface portions 1511 that are spaced from one another and are adapted to bear against the rearward side surface 433 of the protruding flange 43. However, it is preferable to only have two first surface portions 1511 arranged to rest against the rearward side surface 433 of the protruding flange 431 outside the top side and the other outside the bottom side of the strings 41 respectively. Still further, as best shown in FIG. 11, the top member 16 suitably has two hook members 164 although the number may be varied without departing from the inventive concept of the invention. For example, it may be particularly suitable to let the bottom member 15 have two first surface portions 1511, one arranged outside the top side and the other arranged outside the bottom side of the strings 41, in combination with a top member having one second surface portion 161 arranged between the two first surface portions 1511, preferably essentially in the middle of the two first surface portions 1511. The at least one second surface portion 161 adapted to bear against the other side surface 432 of the protruding flange 43 is divided between the hook members 164, so that each hook member 164 has a surface portion 165 adapted to bear against the side surface 432 of the protruding flange 43.

Further, the top member 16 and the bottom member 15, as shown in FIGS. 11 and 10, respectively, have cooperating slanting guide surfaces 162 and 152, respectively, to provide a reduction of the gap width on moving the top member 16 toward the bottom member 15. The angle providing the slanting guide surfaces 162 and 152, respectively, may for example be about 45° although the angle may be varied within a wide range of angles within an interval of more than 0° to 90° for provision of a variable reduction rate of the gap upon movement of the top member 16 toward the bottom member 15. The top member has a slot 163, and a rotary screw 17 extends through the slot 163 into a threaded bore 153 provided in the bottom member 15. Preferably, in order not to risk that the head of the screw 17 interferes with the hand of the guitar player, the slot 163 is stepped, so that the head of the screw 17 is wholly received in an upper portion of the slot 163 and does not project above a top surface of the top member 16. Upon tightening, the screw 17 moves the top member 16 toward the bottom member 15, whereby the cooperating slanting guide surfaces 162 and 152 engage to minimize the gap between the surface portions 151 and 161 and thus clamp the mechanism 1 to the bridge 43 of the guitar 4.

Like in the first embodiment described with reference to FIGS. 1-5, the first actuating lever 21 suitably is generally L-shaped and includes a first end 27 and an opposite end 28. The first end defines a handle 27 adapted to be positioned adjacent a lower side of the guitar strings 41, and the opposite end 28 includes the string engagement means 22. Hereby, the handle 27 is readily accessible and maneuverable for the little finger of a guitarist. Further, like in the previous embodiment the string engagement means 22 may be of various designs well known to a person skilled in the art, but it preferably is formed by the mouth of a through bore (not shown) of sufficient width to permit a guitar string (not shown) to pass through the bore but yet prevent an end piece on the guitar string to pass. The end piece usually is a ring type end piece. If desired, a slot (not shown) may be substituted for the through bore (not shown). Further, the bottom member 15 of the base 11 preferably includes a recess or a bore 18' (see FIG. 19) to permit a free passage of a guitar string (not shown) from the string supporting bridge 43 to the actuating lever 21. Thereby, the guitar string 41 connected to the mechanism 1 can extend freely and straight from the string end piece 411 to the saddle member 435 so that there is no risk of a set tension in the string 41 suddenly being reduced and the string 41 getting out of tune. The shown design contributes to the making of the string engagement means simple, reliable and inexpensive.

The bottom member 15 of the base 11 includes a projecting shaft 111, on which said first actuating lever 21 is journaled for pivotal movement thereon, and a projecting pin 112, which is parallel to the projecting shaft 111. The first actuating lever 21 has a bore 23 for the shaft 111 and a recess 25, into which the projecting pin 112 extends to form an end stop at a home position of the first actuating lever 21 (see FIG. 21). The tension of the guitar string 41 attached to the opposite end 28 of the first actuating lever 21 endeavors to keep the first actuating lever 21 in its home position. Thereby the end stop at the home position is hidden and the hand of a musician playing the guitar will not risk interfering with the end stop. Further, the projecting shaft 111 has a central threaded bore 1111, and the first actuating lever 21 is prevented from leaving the shaft 111 by the head of a screw 24 fitted in the threaded bore 1111. The head of the screw 24 suitably has a countersunk/flat head or an oval/rounded head to protect the hand of a musician playing the guitar. If desired, a finishing (countersunk) washer 241 or the like may be interposed between the head of the screw 24 and the first actuating lever 21.

It is also preferred that the bottom member 15 of the base 11 includes a first tuning screw (not shown, but similar to tuning screw 192 in the previous embodiment) for setting a desired maximum pitch of said first one **41*e* of the guitar strings 41*a*-41*f* upon varying tension on said first one 41*e* of the strings by pivoting said first actuating lever 21 relative to said base 11. The first tuning screw thereby forms an end stop for the pivotal movement of the first actuating lever 21 when using the lever 21 for tensioning the string 41*e* to change the pitch. The first tuning screw is included in a tuning arrangement 19 including a peg 191 projecting from the base 11 and having a bore 193 with threads matching the screw threads. The tuning screw 192 extends through the bore 193 and a helical compression spring (likewise not shown, but similar to the helical compression spring 194 in the previous embodiment) surrounds the screw shank between the screw head and the peg 191 to preload the thread connection to avoid inadvertent loosening or tightening of the tuning screw 192**.

Figure 12:
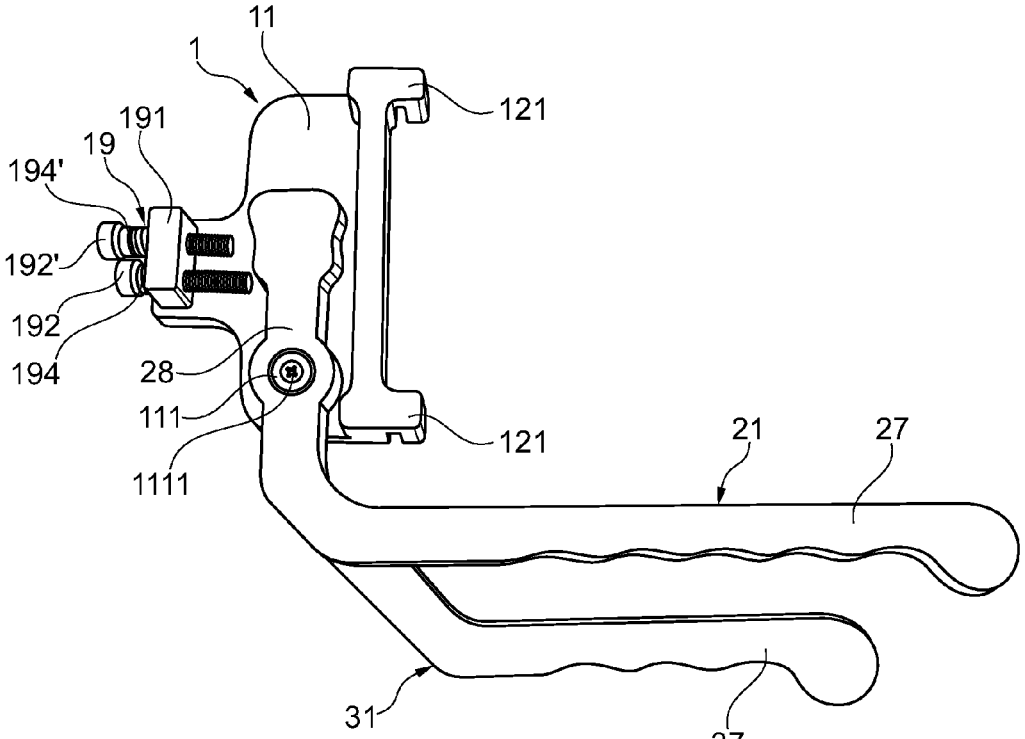
FIG. 12 is a is a front perspective view of a third preferred embodiment of a mechanism according to the invention and having two actuating levers for varying tension on two strings.
Figure 13:
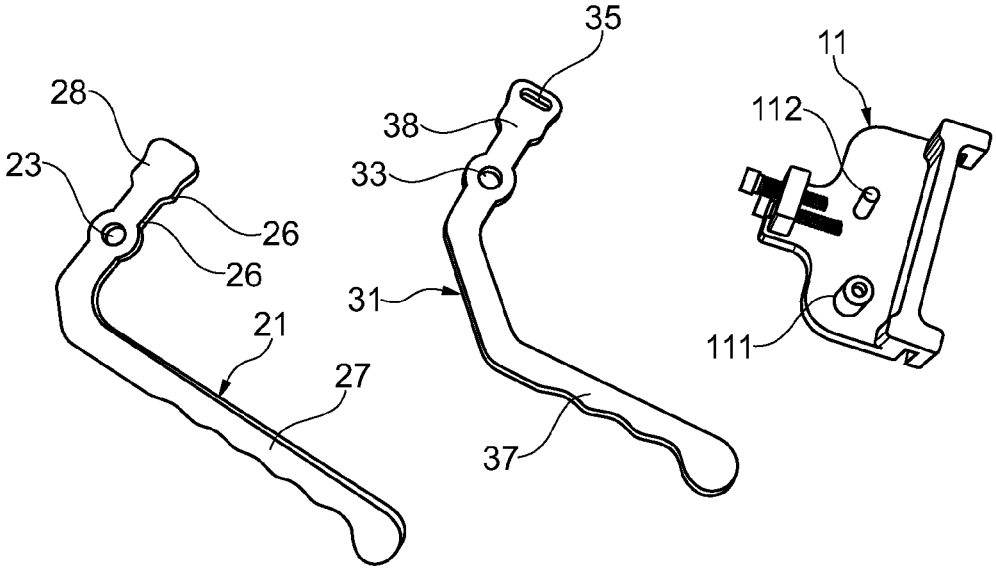
FIG. 13 is a perspective view of the base and the two actuating levers of the mechanism of FIG. 12.

Yet another embodiment is shown in FIGS. 12-18. FIG. 12 shows the complete mechanism 1 with the exception of a screw preventing the mechanism 1 to fall apart. FIG. 13 shows the three main components of the mechanism 1, viz. the base 11, the first actuating lever 21, and the second actuating lever 31. FIG. 14 is a close-up view of the base 11, FIG. 15 shows the second actuating lever 31 mounted on the base 11, and FIG. 16 is a close-up view explaining how the second actuating lever 31 can pivot between two end positions on the base 11.

In the embodiment shown in FIGS. 12-18, the mechanism 1 further comprises a second actuating lever device 31 pivotally attached to a base 11 of the kind shown in FIGS. 1-5, but if desired and as easily realized by a skilled art worker it could alternatively be pivotally attached to a bottom member 15 of the kind shown in FIGS. 7-10. In the embodiment shown in FIGS. 12-18 the second actuating lever device is a second actuating lever 31 that includes string engagement means 22 for connecting a second one 41*f* of said guitar strings 41*a*-41*f* thereto and for varying tension on said second string 41*f* by pivoting said second actuating lever 31 relative to said base 11. Usually, string 41*f* is the $E_4$ string, and operation of the second actuating lever then enables a player to mechanically bend the $E_4$-string up a half tone (one fret) to $F_4$ or a whole tone (two frets) to $F_4$#. However, if desired, the second actuating lever 31 could be connected to one of the other guitar strings 41*a*-41*d* to vary the tension of that string. With two actuating levers 21 and 31, the desired pitch can be obtained for more than one string.

The base 11 shown in FIGS. 1-5 and the bottom member 15 shown in FIGS. 7-10 both include a projecting shaft 111 and a parallel projecting pin 112. Both of the two actuating levers 21 and 31 have a through bore 23 and 33, respectively, fitting the diameter of the shaft 111. To achieve a compact design, it is suitable that also the second actuating lever 31 is journaled on the projecting shaft 111 for pivotal movement thereon. Then, it is preferred that the second actuating lever 31 has a through opening 35 (best shown in FIGS. 13 and 16) and the first actuating lever 21 a recess 25 (shown in FIG. 17), and that the projecting pin 112 extends through the through opening 35 and into the recess 25 to form end stops at a home position of each of the two actuating levers 21 and 31. Thereby the end stops at the home positions are hidden and the hand of a musician playing the guitar will not risk interfering with the end stops. Consequently, the projecting shaft 111 and the projecting pin 112 are longer than if a single actuating lever 21 is journaled on the projecting shaft 111. Naturally, alternative solutions are conceivable. Instead of having two variants of the base 111 or bottom member 15, i.e. one variant with a short projecting shaft 111 and another variant with a longer projecting shaft 111 a sleeve may be arranged outside the longer projecting shaft 111 in case the two lever-variant of the base 11 or bottom member 15 shall be used with the first actuating lever only.

The second actuating lever 31 is sandwiched between the base 11 or bottom member 15 and the first actuating lever 21. As before, the projecting shaft 111 has a central threaded bore 1111 shown in FIGS. 14-16, and the two actuating levers 21 and 31 are prevented from leaving the shaft 111 by the head of a screw 24 shown in FIGS. 1 and 3 fitted in the threaded bore 1111. The head of the screw 24 suitably has a countersunk/flat head or an oval/rounded head to protect the hand of a musician playing the guitar. If desired, a finishing (countersunk) washer 241 or the like may be interposed between the head of the screw 24 and the first actuating lever 21. If desired, antifriction washers of polytetrafluoroethylene, for example, may be positioned on both sides of each lever to reduce friction against the base 11 or bottom member 15, the other actuating lever, and the finishing washer 241.

Figure 18:
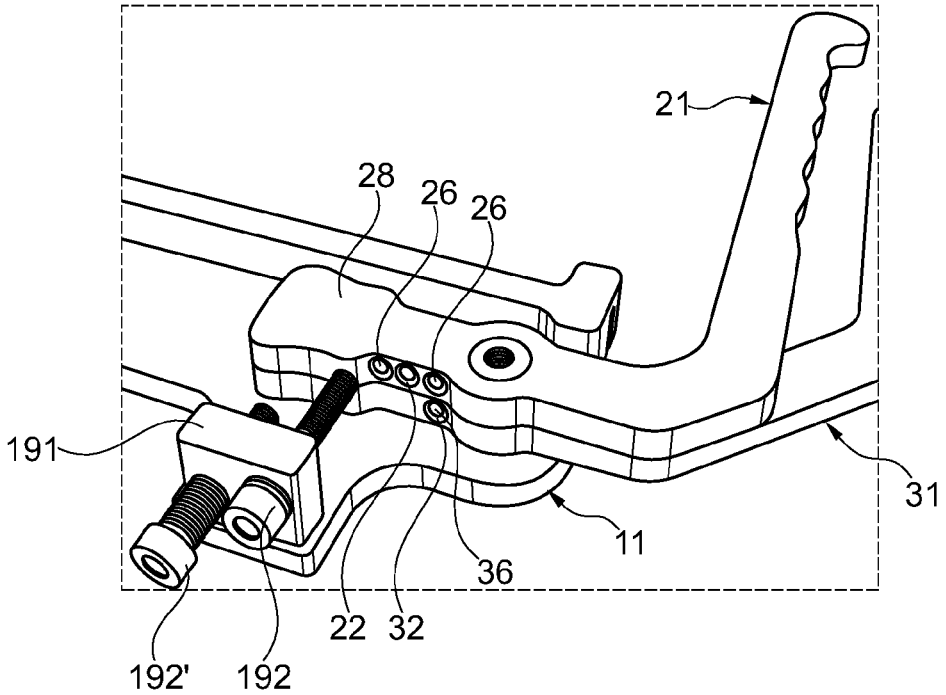
FIG. 18 is a perspective view of the mechanism of FIG. 12 showing string engagement means in the two actuating levers.

Like the shape of the first actuating lever 21 described with reference to FIGS. 1-5 and 7-11, also the second actuating lever 21 suitably is generally L-shaped and includes a first end 37 and an opposite end 38. The first end defines a handle 37 adapted to be positioned adjacent a lower side of the guitar strings 41, and the opposite end 38 includes the string engagement means 32. As is best shown in FIG. 12, the handle 37 of the second actuating lever 31 is located farther away and the handle 27 of the first actuating lever 21 closer to the bottom of the strings 41. Hereby, the handle 37 is readily accessible and maneuverable for the little finger of a guitarist. Further, like in the previous embodiment the string engagement means 32 may be of various designs well known to a person skilled in the art, but as shown in FIG. 18 it preferably is formed by the mouth of a through bore 36 of sufficient width to permit a guitar string (not shown) to pass through the bore but yet prevent an end piece on the guitar string to pass. The end piece usually is a ring type end piece. If desired, a slot (not shown) may be substituted for the through bore 36.

Further, it is also preferred that the base 11 or bottom member 15 includes a second tuning screw 192' for setting a desired maximum pitch of said second one 41*f* of the guitar strings 41 upon varying tension on said second one 41*f* of the strings by pivoting said second actuating lever 31 relative to said base 11 or bottom member 15. The second tuning screw 192' thereby forms an end stop for the pivotal movement of the second actuating lever 31 on tensioning the string 41*f*. Also the second tuning screw 192' is included in the tuning arrangement 19 including the peg 191 projecting from the base 11 or bottom member 15 and having a bore with threads matching the screw threads. The tuning screw 192' extends through the bore and a helical compression spring 194' best shown in FIGS. 14 and 16 surrounds the screw shank between the screw head and the peg 191 to preload the thread connection to avoid inadvertent loosening or tightening of the tuning screw 192'.

Figure 19:
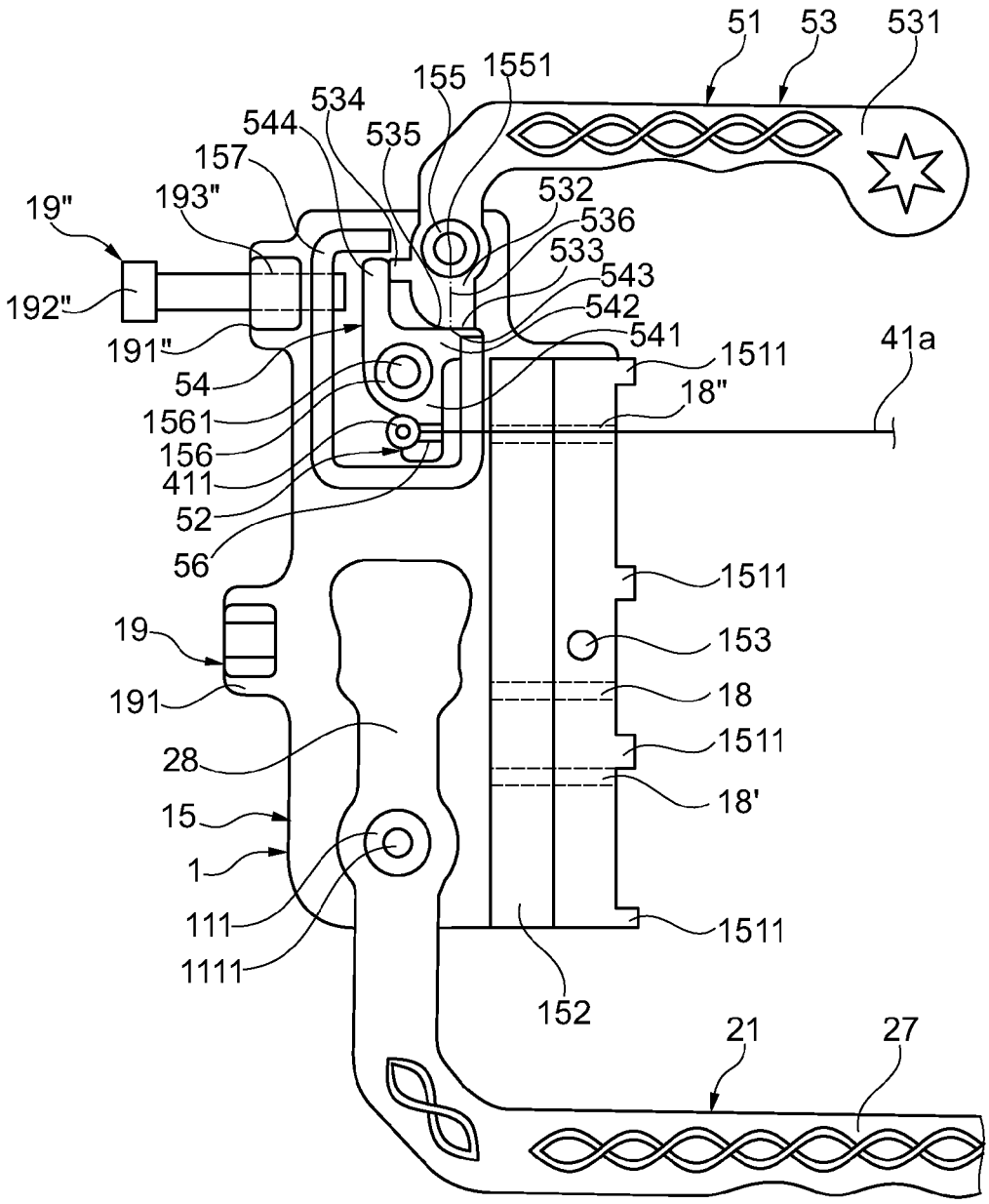
FIG. 19 is a simplified plan view of the mechanism of FIG. 9 but supplemented with a third actuating lever device including a third actuating lever and a fourth lever.
Figure 20:
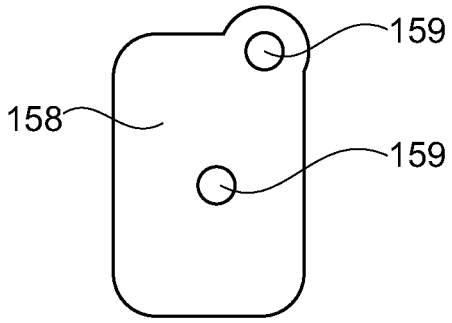
FIG. 20 is a plan view of a lid covering the fourth lever and adjacent part of the third actuating lever.
Figure 21:
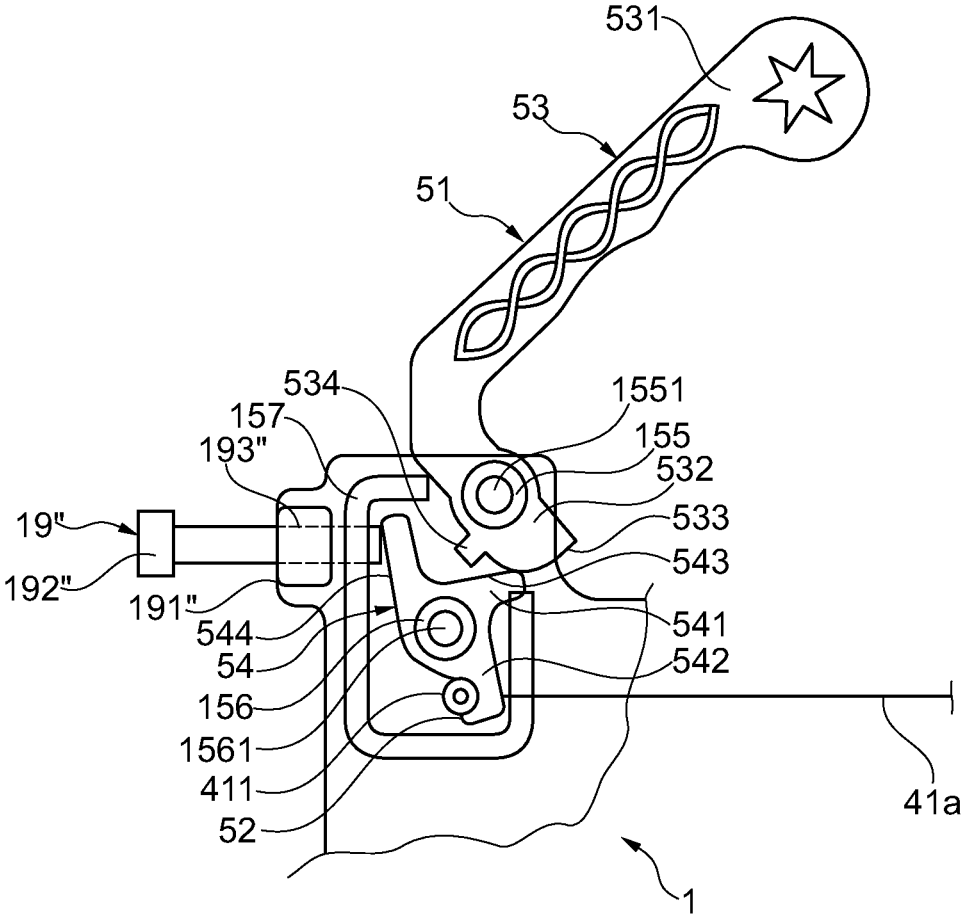
FIG. 21 is a plan view similar to part of FIG. 19 and showing the end positions of the third actuating lever and the fourth lever.

In still another embodiment shown in FIGS. 19-21, the mechanism 1 that already includes the actuating lever device 21 (and, if desired, also a second actuating lever 31), also includes a third actuating lever device 51 for lowering the pitch of a guitar string 41*a*, such as the $E_2$-string, a whole tone step from $E_2$ to $D_2$. In this embodiment, the third actuating lever device 51 is pivotally attached to the bottom member 15 shown in FIGS. 7-10, but if desired, it could instead be pivotally attached to the base 11 shown in FIGS. 1-5. The third actuating lever device 51 includes string engagement means 52 for connecting a third one 41*a* of said guitar strings 41*a*-41*f* thereto and for varying tension on said third one 41*a* of the strings 41 by pivoting said third actuating lever device 51 relative to the bottom member 15 or the base 11.

In the embodiment shown in FIGS. 19-21, the third actuating lever device 51 includes a third actuating lever 53 and a fourth lever 54 that includes the string engagement means 52 and is operatively connected to the third actuating lever 53. The bottom member 15 or base 11 includes a protruding surface where a second projecting shaft 155, on which said third actuating lever 53 is journaled for pivotal movement thereon, and further a third projecting shaft 156, on which the fourth lever 54 is journaled for pivotal movement thereon, are arranged. The protruding surface extends further outside the extension of the uppermost guitar string 41*a* than in the embodiments described earlier. The second projecting shaft 155 and the third projecting shaft 156 are positioned aside of the uppermost guitar string 41*a*. The second projecting shaft 155 is further positioned offset the third projecting shaft 156 seen in a direction perpendicular to the extension of the strings. The third actuating lever 53 is generally L-shaped and includes a first end 531 and an opposite end 532, the first end defining a handle 531 adapted to be positioned adjacent a top side of the guitar strings 41*a*-41*f*, and the opposite end 532 includes a first guide surface 533. The fourth lever 54 suitably has a first arm 541 extending in transversal direction to the extension of the strings including said string engagement means 52, and a second arm 542 extending in a forward direction parallel to the strings and having a second guide surface 543 cooperating with said first guide surface 533. The tension force in the string 41*a* attached to the string engagement means 52 on the first arm 541 acts to rotate the fourth lever 54, but the first and second guide surface 533 and 543 together form an eccentric lock when the handle 531 of the third actuating lever 53 is in a home position adjacent the top side of the guitar strings 41*a*-41*f*. Preferably, the second guide surface 543 is flat, and the first guide surface 533 has an opposite flat portion and a rearward facing curved portion. In the embodiment of FIG. 19 the transition 535 between these two portions is located aside of an imaginary line 536 which is perpendicular to the second guide surface 543 and which runs through the center of the second pivot shaft 155. The second guide surface 543 thereby extending on both sides of said imaginary line 536, the transition being located about one millimeter aside of said imaginary line 536. Thereby, the tension in the guitar string 41*a* cannot make the handle 531 move away from the locked home position.

Similar to the embodiments described above, the string engagement means 52 may be of various designs well known to a person skilled in the art, but as shown in FIG. 19, it preferably is formed by the mouth of a through bore 56 of sufficient width to permit a guitar string 41*a* to pass through the bore 56 but yet prevent an end piece 411 on the guitar string 41*a* to pass. The end piece 411 usually is a ring type end piece. If desired, a slot (not shown) may be substituted for the through bore 56. Further, the bottom member 15 or the base 11 preferably includes a recess or a bore 18" to permit a free passage of a guitar string 41*a* from the string supporting bridge 43 to the actuating lever device 51. Thereby, the guitar string 41*a* connected to the mechanism 1 can extend freely and straight from the string end piece 411 to the saddle member 435 so that there is no risk of a set tension in the string 41*a* suddenly being reduced and the string 41*a* getting out of tune.

It is also preferred that the bottom member 15 or the base 11 includes a third tuning screw 192" for setting a desired minimum pitch of said third one 41*a* of said guitar strings 41*a*-41*f* upon varying tension on said third one 41*a* of the strings by pivoting said third actuating lever 53 relative to the bottom member 15 or the base 11. The third tuning screw 192" is included in a third tuning arrangement 19" including a peg 191" projecting from the bottom member 15 or the base 11 and having a bore 193" with threads matching the screw threads. The third tuning screw 192" extends through the bore 193", and like in the first tuning arrangement 19 a helical compression spring (not shown) surrounds the screw shank between the screw head and the peg 191" to preload the thread connection to avoid inadvertent loosening or tightening of the tuning screw 192". As shown in FIG. 21, by pivoting the third actuating lever 53 from its home position, the eccentric lock is opened. The tension in the string 41*a* makes the fourth lever 54 rotate to make a rearward side of a third arm 544 of the fourth lever 54 bear on a free end of the tuning screw 192" so as to permit the pitch of the string 41*a* to be lowered a whole tone step (two frets).

To secure that a return movement of the handle 531 to its home position will not pass the exact home position, the opposite end 532 of the third actuating lever 53 suitably has a rearward facing shoulder 534, which on moving the handle 531 to its locked home position will bear against a forward side of the third arm 544. Further, a wall 157 projects from the bottom member 15 or base 11 and surrounds a major portion of the fourth lever 54. Each of the second pivot shaft 155 and the third pivot shaft 156 has a central threaded bore 1551 and 1561, respectively. A cover 158 (shown in FIG. 20) having two through bores 159 covers the area enclosed by the wall 157 and is attached to the second and third pivot shafts 155 and 156 by screws (not shown) extending through the bores 157 and into the threaded bores 1551 and 1561. The heads of the screws may be dome-shaped or, if desired, the screws may be of the same type as screws 24 with finishing washer 241 but smaller. Further, if desired, anti-friction washers of PTFE, for example, may be positioned on both sides of each lever to reduce friction against the bottom member 15 or the base 11, and the cover 158.

In still another embodiment, not shown, it may be desirable to dispense with the first and second actuating lever devices 21 and 31, respectively and to use the mechanism 1 only to lower the pitch of a guitar string, such as the $E_2$-string, a whole tone step from $E_2$ to $D_2$. Thus, in this embodiment, there is no actuating lever device 21 and no second actuating lever 31. The third actuating lever device 51 is the sole actuating lever device and is so termed in order not to be mixed up with the first actuating lever device. Consequently, in this embodiment, the mechanism 1 uses the clamping means 12 shown in FIGS. 1-5 or the one shown in FIGS. 7-11. Neither the base 11 nor the bottom member 15 includes pivot shaft 111 and tuning arrangement 19 with projecting peg 191 and tuning screw 192. In other respects, the mechanism of the embodiment is identical to the one described with reference to FIGS. 19-21 above.

The invention claimed is:

1. A mechanism for changing a pitch of a guitar string of an electric guitar having a plurality of guitar strings and a guitar body with a string supporting bridge mounted on said guitar body, said strings having a main direction, and said bridge having a protruding flange that has two opposed side surfaces and extends perpendicularly to said main direction and said guitar body, said mechanism comprising:

a base, which has at least one surface portion adapted to bear against one of said side surfaces of the protruding flange;

an actuating lever device pivotally attached to said base, said actuating lever device including a string engagement for connecting a first one of said guitar strings thereto and for varying tension on said first one of the strings by pivoting said actuating lever device relative to said base; and a clamp carried by said base and operable to removably clamp said base to both sides of said flange, so as to attach the mechanism to the bridge without any part of said mechanism extending into said guitar body.

2. A mechanism as claimed in claim 1, wherein said clamp includes:

at least one hook member integral with the base and adapted to be put down over said protruding flange, said at least one surface portion being positioned on the hook member; and a screw member extending through a matching threaded bore provided in the base, said screw member having one end adapted to bear against one of the opposed side surfaces of the flange, and on tightening of the screw member pull said at least one surface portion on said at least one hook member against the other one of said side surfaces of the protruding flange and thus clamp the mechanism to the bridge of the guitar.

3. A mechanism as claimed in claim 1, wherein said base includes a bottom member having at least one first surface portion adapted to bear against one of said side surfaces of the protruding flange, and a top member having at least one second surface portion adapted to bear against the other one of said side surfaces of the protruding flange, said at least one first surface portion and said at least one second surface portion forming a gap between them, said top member and said bottom member being displaceable relative each other to adjust the width of the gap, said top member and said bottom member having cooperating slanting guide surfaces to provide a reduction of the gap width on moving the top member toward the bottom member, the top member having a slot, and a rotary screw extending through the slot into a threaded bore provided in the bottom member, said screw upon tightening moving the top member toward the bottom member, whereby the cooperating slanting surfaces engage to minimize the gap and thus clamp the mechanism to the bridge of the guitar.

4. A mechanism as claimed in claim 3, wherein the bottom member has at least one recess for receiving heads of screws located in said flange.

5. A mechanism as claimed in claim 4, wherein the bottom member has four first surface portions that are spaced from one another and are adapted to bear against one of said side surfaces of the protruding flange.

6. A mechanism as claimed in claim 3, wherein the top member has two hook members, and each hook member has a second surface portion adapted to bear against said other one of said side surfaces of the protruding flange.

7. A mechanism as claimed in claim 1, wherein said actuating lever device includes a first actuating lever, and said base includes a projecting shaft, on which said first actuating lever is journaled for pivotal movement thereon, and a projecting pin, which is parallel to the projecting shaft, said first actuating lever having a recess, said projecting pin extending into said recess to form an end stop at a home position of the first actuating lever.

8. A mechanism as claimed in claim 7, wherein said base includes a first tuning screw for setting a desired maximum pitch of said first one of the strings upon varying tension on said first one of the strings by pivoting said first actuating lever relative to said base.

9. A mechanism as claimed in claim 8, wherein said first actuating lever includes a first end and an opposite end, the first end defining a handle adapted to be positioned adjacent a lower side of the guitar strings, and the opposite end including said string engagement.

10. A mechanism as claimed in claim 9, further comprising a second actuating lever pivotally attached to said base, said second actuating lever including a string engagement mans for connecting a second one of said guitar strings thereto and for varying tension on said second one of the strings by pivoting said second actuating lever relative to said base, and said actuating levers are pivotal on a common axis.

11. A mechanism as claimed in claim 10, wherein also said second actuating lever is journaled on the projecting shaft for pivotal movement thereon.

12. A mechanism as claimed in claim 11, wherein said base includes a projecting pin, which is parallel to the projecting shaft, said second actuating lever having a through opening, and said first actuating lever having a recess, said projecting pin extending through said through opening and into said recess to form end stops at a home position of each of the actuating levers.

13. A mechanism as claimed in claim 12, wherein said base includes a second tuning screw for setting a desired maximum pitch of said second one of the guitar strings upon varying tension on said second one of the strings by pivoting said second actuating lever relative to said base.

14. A mechanism as claimed in claim 1, wherein said actuating lever device includes a third actuating lever and a fourth lever that includes said string engagement and is operatively connected to the third actuating lever, and said base includes a second projecting shaft, on which said third actuating lever is journaled for pivotal movement thereon, and a third projecting shaft, on which the fourth lever is journaled for pivotal movement thereon, said third actuating lever includes a first end and an opposite end, the first end defining a handle adapted to be positioned adjacent a top side of the guitar strings, and the opposite end including a first guide surface, said fourth lever having a first arm including said string engagement, and a second arm having a second guide surface cooperating with said first guide surface.

15. A mechanism as claimed in claim 14, wherein the first and second guide surface together form an eccentric lock when the handle of the third actuating lever is in a home position adjacent said top side of the guitar strings.

16. A mechanism as claimed in claim 15, wherein said base includes a third tuning screw for setting a desired minimum pitch of said first one of said guitar strings upon varying tension on said first one of the strings by pivoting said third actuating lever and thereby also the fourth lever relative to said base, said fourth lever having a third arm, the pivotal movement of which is stopped by a free end of the third tuning screw.

17. A mechanism as claimed in claim 10, further comprising a third actuating lever pivotally attached to said base, said third actuating lever including a string engagement for connecting a third one of said guitar strings thereto and for varying tension on said third one of the strings by pivoting said third actuating lever device relative to said base.

18. A mechanism as claimed claim 17, wherein said third actuating lever includes a third actuating lever and a fourth lever that includes said string engagement and is operatively connected to the third actuating lever, said base includes a second projecting shaft, on which said third actuating lever is journaled for pivotal movement thereon, and a third projecting shaft, on which the fourth lever is journaled for pivotal movement thereon, said third actuating lever includes a first end and an opposite end, the first end defining a handle adapted to be positioned adjacent a top side of the guitar strings, and the opposite end including a first guide surface, said fourth lever having a first arm including said string engagement, and a second arm having a second guide surface cooperating with said first guide surface, the first and second guide surface together form an eccentric lock when the handle of the third actuating lever is in a home position adjacent a top side of the guitar strings, and said base includes a third tuning screw for setting a desired minimum pitch of said third one of said guitar strings upon varying tension on said third one of the strings by pivoting said third actuating lever relative to said base, said fourth lever having a third arm, the pivotal movement of which is stopped by a free end of the third tuning screw.

19. A mechanism as claimed in claim 1, wherein said string engagement includes a through bore of sufficient width to permit a guitar string to pass through the bore but yet prevent an end piece on the guitar string to pass.

20. A mechanism as claimed in claim 19, wherein the base includes a recess or a bore to permit a free passage of a guitar string from the string supporting bridge to the actuating lever device.

* * * * *